US011278767B2

(12) United States Patent
Lucas

(10) Patent No.: US 11,278,767 B2
(45) Date of Patent: Mar. 22, 2022

(54) SWIM GOGGLES WITH ADJUSTABLE SPACER

(71) Applicant: Thierry Lucas, Langenargen (DE)

(72) Inventor: Thierry Lucas, Langenargen (DE)

( * ) Notice: Subject to any disclaimer, the term of this patent is extended or adjusted under 35 U.S.C. 154(b) by 179 days.

(21) Appl. No.: 16/205,000

(22) Filed: Nov. 29, 2018

(65) Prior Publication Data

US 2019/0351291 A1 Nov. 21, 2019

(30) Foreign Application Priority Data

Nov. 30, 2017 (DE) ..... 102017128468.0

(51) Int. Cl.
*A63B 33/00* (2006.01)

(52) U.S. Cl.
CPC ..... *A63B 33/002* (2013.01); *A63B 33/006* (2020.08)

(58) Field of Classification Search
CPC ... A63B 33/006; A63B 33/008; A63B 33/002; A63B 33/004; G02C 5/045; G02C 5/04; G02C 5/20; G02C 5/15; G02C 5/16; G02C 5/10; G02C 9/04; G02C 11/02; A47B 21/02; Y10T 24/1437; Y10T 24/1451; Y10T 24/2177; Y10T 24/44043; Y10T 403/295; F16B 7/06; F16G 11/12; A41F 1/008; A41F 1/00; A41F 2005/027
USPC ..... 2/428, 446, 426; 24/277, 569, 20 LS; 403/43, 46, 7; 464/170
See application file for complete search history.

(56) References Cited

U.S. PATENT DOCUMENTS

| | | | | |
|---|---|---|---|---|
| 1,793,211 | A | 2/1931 | Day et al. | |
| 2,856,813 | A * | 10/1958 | Kudelko | G02C 5/045 351/109 |
| 2004/0088779 | A1* | 5/2004 | Kita | A61F 9/025 2/443 |
| 2007/0022521 | A1 | 2/2007 | Seynhaeve et al. | |
| 2010/0175174 | A1* | 7/2010 | Chou | A63B 33/002 2/446 |
| 2016/0223840 | A1* | 8/2016 | Chute | G02C 5/006 |

FOREIGN PATENT DOCUMENTS

| | | |
|---|---|---|
| DE | 8102997 | 8/1981 |
| GB | 845535 | 8/1960 |
| WO | 2017/194884 | 11/2017 |
| WO | 2019/036629 A1 | 2/2019 |

* cited by examiner

*Primary Examiner* — Nathan E Durham
*Assistant Examiner* — Abby M Spatz
(74) *Attorney, Agent, or Firm* — Faegre Drinker Biddle & Reath LLP

(57) ABSTRACT

A swim goggles (1) with a spacing adjuster, comprising a left and right eyepiece (2) retained in a frame (4), and an adjustment means (6) for adjusting the spacing (7) between the left and right eyepieces (2) composed of a rotating element (16), which is located between two connecting pieces (5), such that it can be adjusted, and is connected at each end with two opposing threaded connections (18, 19; 20, 21) to the connecting pieces (5), wherein the connecting pieces (5) have a twisting safeguard (8, 8*a*, 34) that prevents a twisting of the connecting pieces (5) counter to one another in the frame (4).

15 Claims, 9 Drawing Sheets

SWIM GOGGLES WITH ADJUSTABLE SPACER

CROSS-REFERENCE TO RELATED APPLICATION

The present application claims priority to DE 102017128468.0, filed Nov. 30, 2017, the entire disclosure of which is hereby expressly incorporated herein by reference.

BACKGROUND/SUMMARY

The disclosure relates to swim goggles with an adjustable spacer between the left and right eyepieces.

In the prior art, US 2007/0022521 A1 discloses swim goggles with an elastic connecting element between the left and right eyepieces. In order to adjust the spacing between the two eyepieces, it can be snapped into the left and right eyepieces at different lengths by means of a lug and strap connection.

With another commercially available swim goggles, there is a leg of the nosepiece that connects the left and right eyepieces at their respective sides facing the other eyepiece that can be adjusted with a threading. This design is described in WO 2017/194884 A1. The threaded adjustment takes place separately on the left and right eyepieces by means of a screwdriver. In this manner, by turning the threaded screw on the nosepiece, the nosepiece is moved upward in relation to the eyepiece, and away from it, or if it is turned in the other direction, the nosepiece is moved downward, toward the eyepiece. As a result of the shape of the legs of the nosepiece, spread out to form a "V," a change in the spacing between the left and right eyepieces is obtained.

Swim goggles are known from the subject matter of GB 845 535 C, in which the spacing adjustment of the nosepiece between the left and right eyepieces is composed of an adjustable rotating element, which is located in the middle between two connecting pieces on the frames of the eyepieces and connected at its ends to corner pieces with two threaded screw connections acting in opposite directions, which are integrated in the eyepiece frames.

The attachment of the corner pieces is obtained through vertical rivets, and there are tongues in each of the corner pieces into which a threaded nut is seated.

Accordingly, the one nut has a left-hand thread, and the complementary nut forms a right-hand thread, wherein there are threaded bolts on the ends of the rotating element that engage in the dedicated threads of the nuts.

If the rotating element is rotated with the fingers of a hand in one direction, the spacing between the eyepieces is reduced. If it is rotated in the other direction, the spacing is increased.

The disadvantage with this assembly is that it comprises numerous pieces and a complicated assembly, because the corner pieces must be secured to the frame with vertical rivets, resulting in an attachment that can be easily broken.

The articulated connection between the corner pieces supporting the nuts and the frame is formed by the rivets, such they can only rotate in the vertical axis about the rivets, such that the nosepiece can be flexible.

The use of corner pieces and tongues formed thereon results in an elongated structural length, such that the rotating element must be miniaturized so that the nosepiece is not too long. This miniaturization increases the difficulty of manipulating it.

The swim goggles specified above also have the disadvantage that the two corner pieces can be rotated against one another, which is largely prevented in the known swim goggles in that there is an elastic film-like attachment between the eyepieces in the region of the nosepiece, which protects the eyepiece lenses from being twisted within a specific rotational range.

There is also the danger that, despite the film bridging the nose, the eyepiece lenses can be rotated in the goggles frame, making them difficult to manipulate and uncomfortable for the wearer.

For this reason, the fundamental object of the disclosure is to further develop a swim goggles of the type specified in the introduction, such that the eyepiece lenses cannot become twisted or tilted in relation to one another—even when adjusting the spacing—thus resulting in improved manipulation of the swim goggles.

This problem is solved by the disclosure through the technical teachings of claim 1.

The solution to this problem is obtained through the features of claim 1. Advantageous and useful further developments can be derived from the dependent claims.

In a preferred design, the connecting piece has a twisting safeguard that prevents a twisting of the connecting piece in the frame.

As a result, the swim goggles according to the disclosure no longer depend on the elastic connection between the lenses that bridges the nose, and instead, the twisting safeguard is located in the spacer itself.

In an exemplary design, the twisting safeguard is composed of a sleeve element that encompasses the rotating element and is non-rotatably connected at both ends to the respective connecting piece.

It is preferred thereby that the non-rotating connection of the sleeve element to the connecting pieces is composed of a tongue and groove connection. This has the advantage that the sleeve element can be easily snapped in place or slid axially onto the two opposing connecting pieces, resulting in a twisting safeguard between the connecting pieces.

In another design, the twisting safeguard is composed of a connecting rod that passes axially through the rotating element and the two connecting pieces, and is non-rotatably secured in the two opposing connecting pieces.

It is preferred in all of the embodiments that each of the connecting pieces is composed of a basically cylindrical head part, in which the one part of the complementary threaded connection is located.

According to another preferred feature, the connecting piece is connected in an articulated manner to the frame of the swim goggles with a ball joint or a flexible elastic hinge. This results in an excellent adjustment of the swim goggles to different head shapes of the wearer.

The ball joint is preferably designed such that it can be inserted in the frame of the swim goggles in a dedicated ball socket. As a result, the part of the swim goggles connecting the two lenses can be easily removed.

The inventive subject matter of the present disclosure can be derived not only from the subject matter of the individual claims but also from the combination of individual claims with one another.

All of the information and features disclosed in the documents, including the abstract, in particular the spatial designs shown in the drawings, can be claimed as part of the disclosure. The use of the terms "substantial" or "according to the disclosure" or "substantial to the disclosure" is subjective and does not imply that the features specified as such must be a component of one or more claims.

BRIEF DESCRIPTION OF THE DRAWINGS

Embodiments of the disclosure shall be explained in greater detail below with reference to the attached figures. Therein.

DETAILED DESCRIPTION

Figure 1:
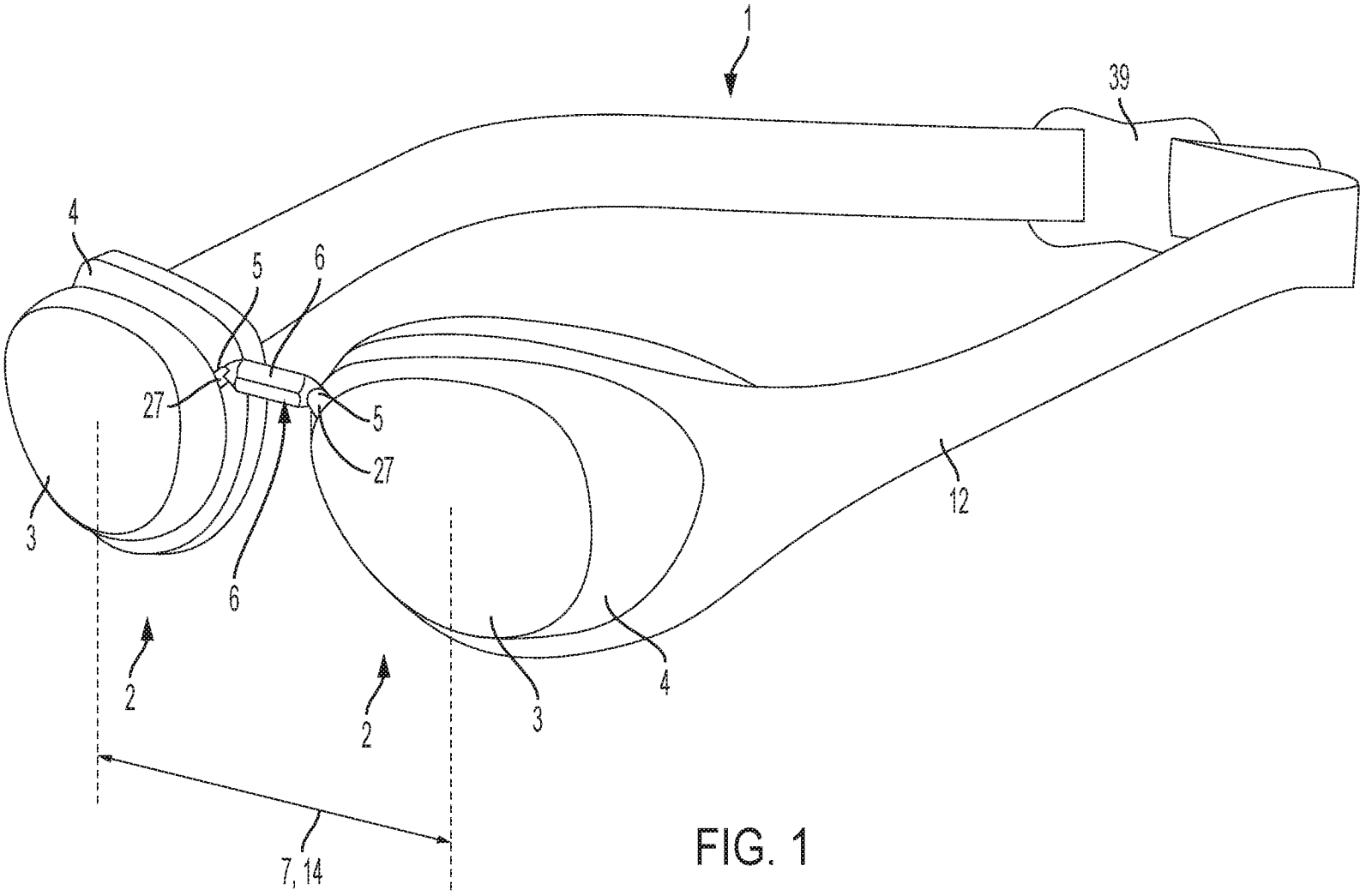
FIG. 1: shows a perspective view of a swim goggles in a simplified illustration.

FIG. 1 shows a swimming goggles 1 in a perspective view, wherein two eyepiece lenses 2 are located in a frame 4, each of which has a front lens 3.

The eyepiece 2 fits into the frame 4 of the swim goggles 1, and two lateral headbands 12 adjoin the frame 4, which are connected at the back by a connecting clasp 39.

The spacing 7 between the lenses 3 can be adjusted to the spacing between the eyes 14 by the adjustment device according to the disclosure, located in the region of the nosepiece. Adjustment means 6 are provided for this, which are composed of a rotating element 16 in the exemplary embodiment—first shown in the following figures—which is encompassed by a sleeve element 8, 8*a* (see the following figures).

The assembly of the adjustment means 6, 6*a*, 6*b*, 6*c* is only indicated schematically in FIG. 1, and it can also be seen that the adjustment means 6 are connected in an articulated manner to the connecting pieces 5 on the frame.

A twisting of the two opposing lenses 3 in the eyepieces 2 is prevented in the region of the adjustment means 6 by the twisting safeguard according to the disclosure. The articulated connection of the connecting piece 5 in the frame 4 is preferably obtained by a ball joint 27 in each case, which shall be explained in greater detail in reference to the following figures.

Instead of the articulated connection of the connecting piece 5 to the frame 4, the ball joint 27 can also be omitted, and instead, a flexible connection can be provided between the bottom surface of the connecting piece 5 and the frame 4. Such a flexible connection is composed of a flexible elastic rod, which is connected to or formed on the dedicated components at both ends.

Figure 2:
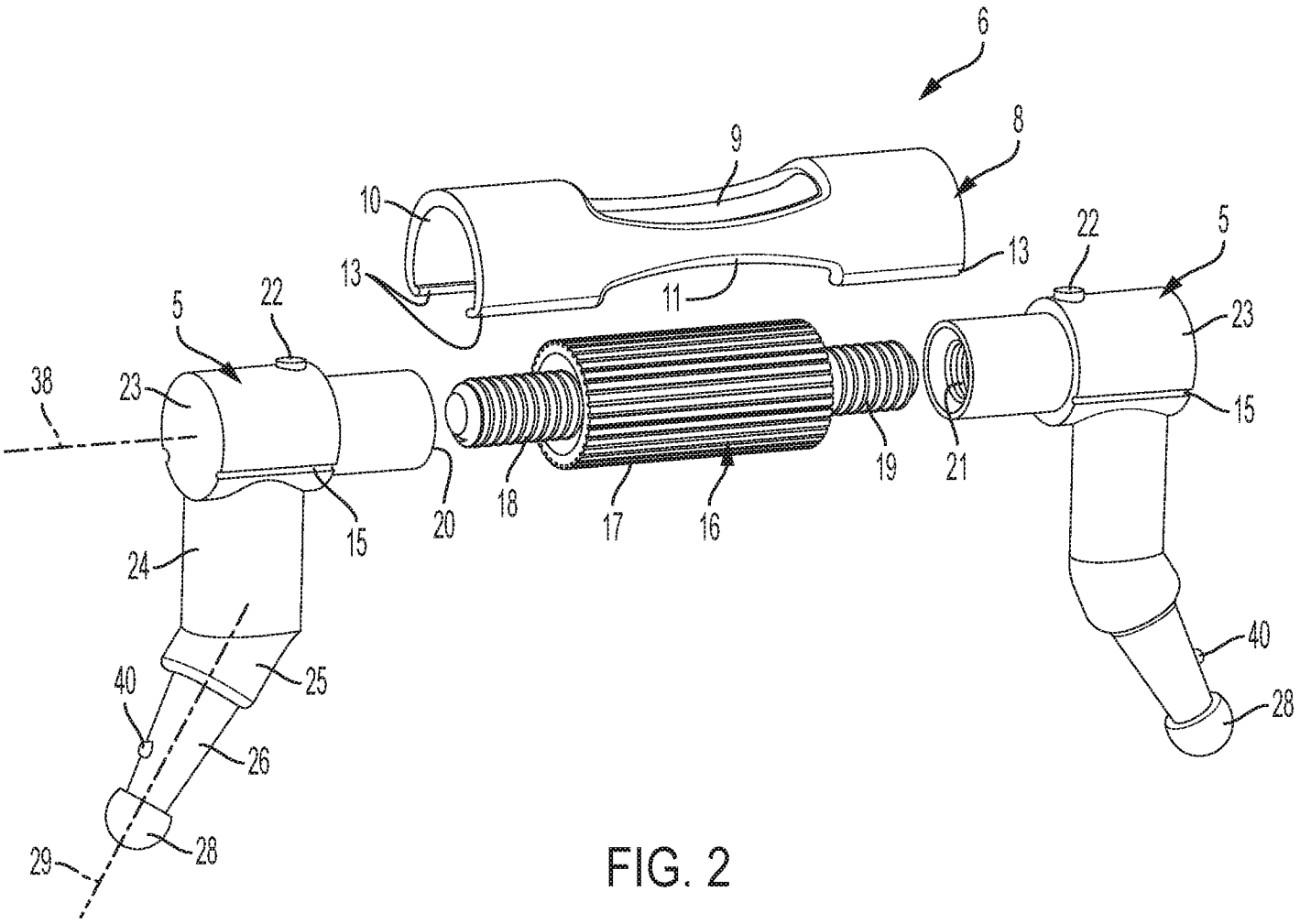
FIG. 2: shows an exploded view of the components of the spacing adjustment at the nosepiece end, in a first embodiment.
Figure 3:
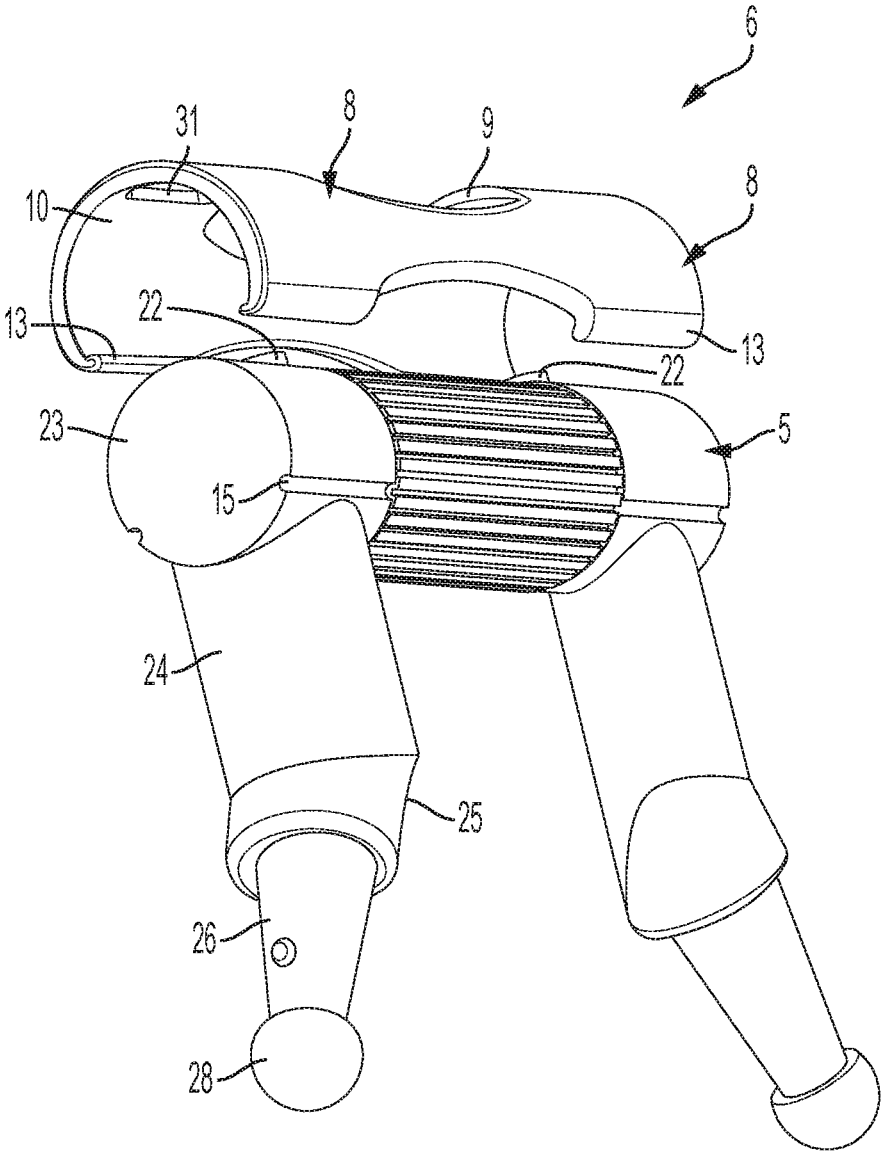
FIG. 3: shows the same illustration in FIG. 2, in a nearly assembled state.
Figure 4:
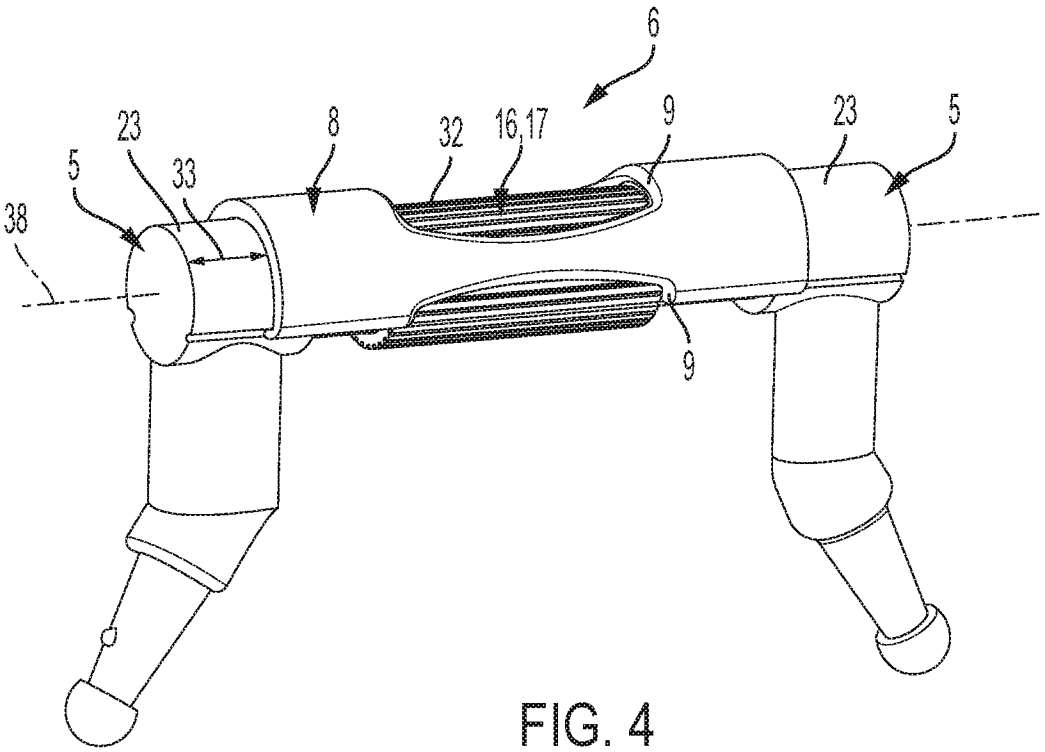
FIG. 4: shows a perspective view of the first embodiment in the functional state.

A first preferred design of the adjustment means 6 is shown in FIGS. 2 to 4, wherein the entire assembly is symmetrical to the central longitudinal axis in the exemplary embodiment shown therein, meaning that the connecting pieces 5 are identical and each connecting piece is composed of a basically cylindrical head part 23 with a sleeve extension at the front, each of which has a threaded bore 20, 21. One of the threaded bores 20 can have a left-hand thread and the other threaded bore 21 can have a right-hand thread.

An extension 24 is formed on the cylindrical head part 23, oriented basically perpendicular to the longitudinal axis 38 of the head part 23, and transitioning into an angled piece 25 bent out therefrom at its base, on which a foot 26 is formed at its lower end, on the lower end of which a ball 28 is formed for the aforementioned ball joint 27.

The ball 28 engages in a hole in the frame 4, not shown in greater detail, and a stud 40 can be located on the foot 26 that serves as a safeguard to prevent the ball 28 from being pulled out of the ball-shaped socket in the frame, which extends into the hole in the frame and a socket located therein in a form fitting manner, and serves to prevent the ball from being pulled out.

The angle of the angle piece 25 to the foot 26 formed in the same direction thereon in relation to the axis of the bend 29 has the advantage that a larger actuation space and a larger actuating surface is defined between the connecting pieces 5, in order to thus obtain a simple and readily gripped actuation of a rotating element 16 located there. As a result, there is no need to miniaturize the adjustment component, as was the case in the prior art.

The rotating element 16 is preferably made of plastic, and has a contoured gripping sleeve 17 that has threaded bolts 18, 19 formed on both ends, the threads of which fit into the threads of the complementary dedicated threaded holes 20, 21.

In order to form the twisting safeguard, it is then provided that the rotating element 16 is encompassed at least at the top by a sleeve element 8, which has at least an upper gripping window 9 in the form of a hole in the basically semi-circular cylindrical sleeve element 8.

The lateral surface of the sleeve element 8 is likewise provided with a lateral cutout, and the sleeve element is only semicircular, in order to obtain a convenient gripping surface for the fingers of a hand that encompasses nearly the entire circumference, in order to rotate the rotating element 16.

The twisting safeguard is formed in that a tongue and groove connection is formed between the sleeve element and the two opposing connecting pieces 5, in that opposing longitudinal profiles are formed, for example, on the inner surface of the profile of the sleeve element 8, which can be snapped or slid into dedicated longitudinal grooves 15 on the undersurface of the respective head part 23 of the connecting piece 5.

The sleeve element 8 forms a non-rotatable connection between the connecting pieces 5 in this manner, which thus can no longer be twisted about their longitudinal axis 38 in relation to one another.

A kinematic reversal of such a tongue and groove connection is also possible, as a matter of course, such that instead of longitudinal grooves 15 formed on both sides of the respective head part 23 of the connecting pieces 5, tongues are formed thereon, which engage in dedicated grooves on the inner surface of the sleeve element 8.

For a further twisting safeguard, or as a sole twisting safeguard, a nub-shaped guide 22 can be located on the upper surface of the respective head part 23, which engages in, or can be slid into a dedicated longitudinal groove 31 formed on the inner surface of the sleeve element 8.

The same relationships as those described in reference to FIG. 2 are shown in FIG. 3 with the same reference symbols. In this exemplary embodiment, the nosepiece spacing adjuster is nearly fully assembled. The sleeve element 8 only needs to be snapped or slid on with its inward-facing longitudinal profiles 13, which engage in the dedicated longitudinal grooves 15 on the respective connecting pieces 5.

In another design, the sleeve element 8 can also be slid onto the two connecting pieces 5 along the longitudinal axis 38.

FIG. 4 shows the fully assembled state of the first embodiment according to the disclosure, wherein it can be seen that by rotating the rotating element 16, the connecting pieces 5 are displaced in the directions of the arrows 33, wherein the connecting pieces 5 are slid along the sleeve element 8 due to the tongue and groove connection 13, 15.

It can be derived from FIG. 4 that as a result of the special shape of the sleeve element 8, a large gripping window 9 can be obtained, because this is preferably made of a semi-circular cylinder 10, such that the entire lower region of the sleeve element 8 serves as a gripping surface for rotating the rotating element 16.

Figure 5:
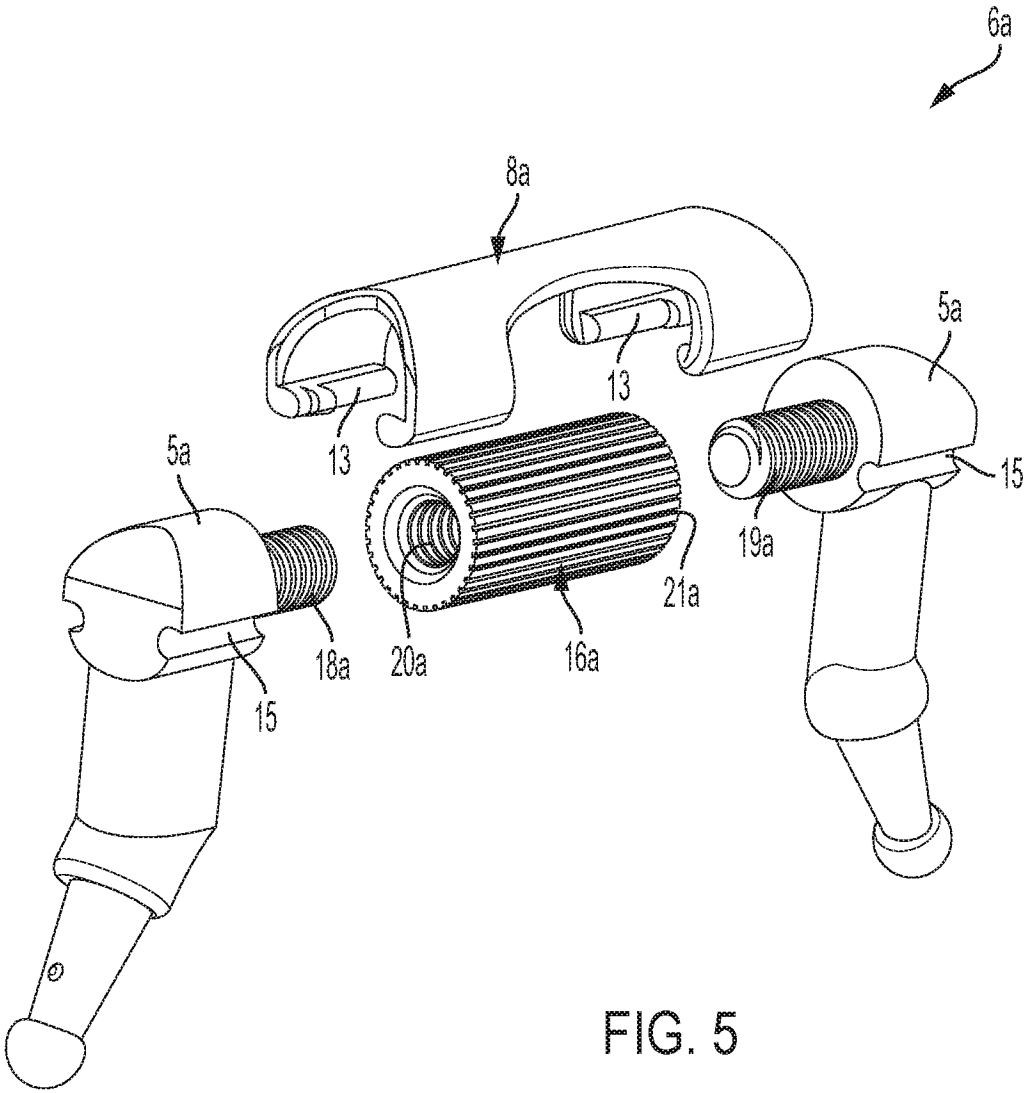
FIG. 5: shows a modified version of the first embodiment in an exploded view.

FIG. 5 shows the kinematic reversal of the threaded connection between the rotating element 16 and the dedicated connecting pieces 5*a*. The rotating element shown 16*a* shown therein has threaded bores 20*a*, 21*a* on its opposite ends, with opposing threads, and into which the dedicated threaded bolts 18*a*, 19*a*, now formed on the connecting pieces 5*a*, are screwed.

The entire adjustment means is indicated for this reason with the reference symbol 6*a*.

The sleeve element 8*a* is basically the same, because it also has the twisting safeguard described above, with the longitudinal guide.

Figure 6:
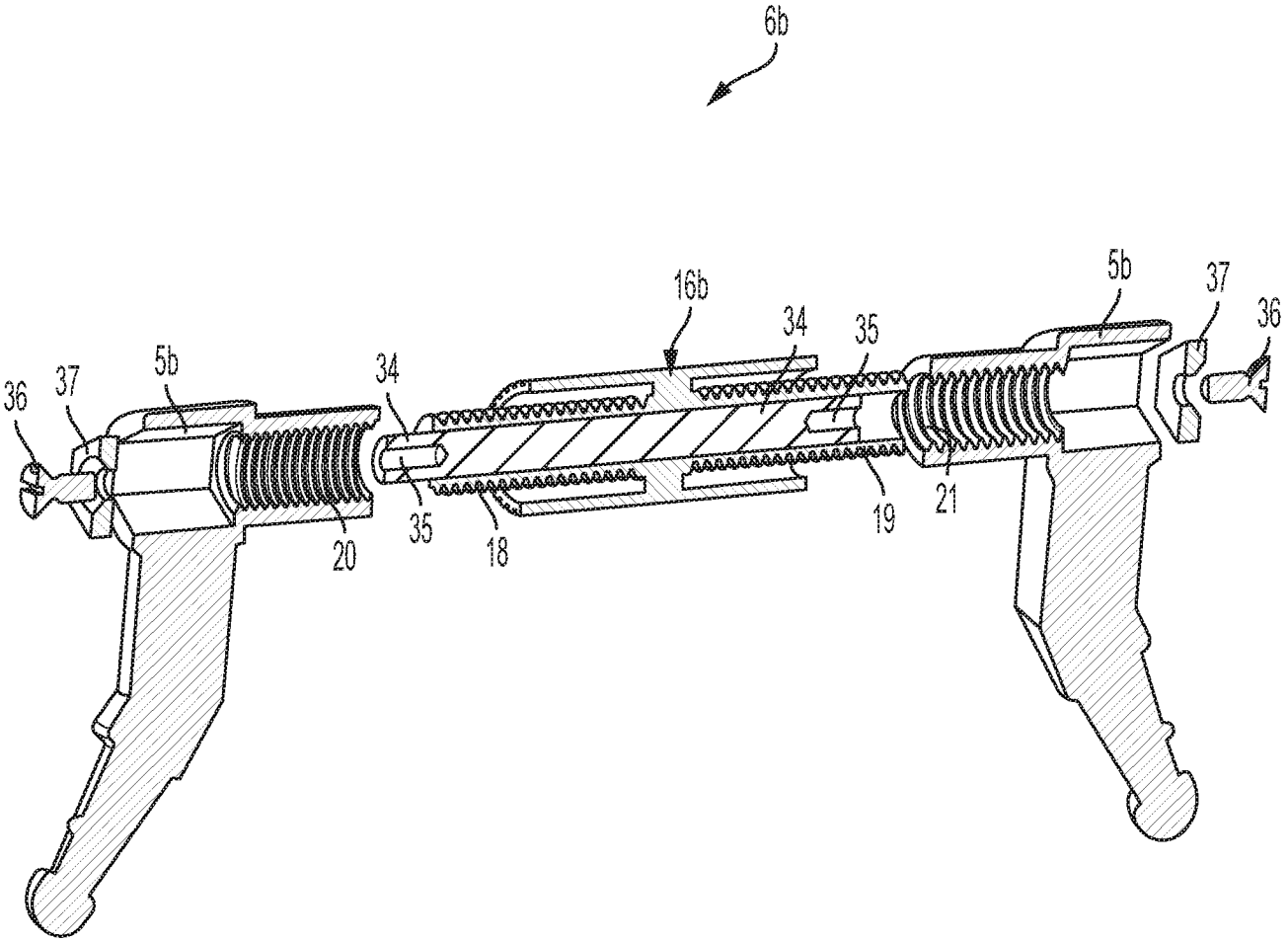
FIG. 6: shows a third embodiment with respect to FIG. 5 and FIG. 2, in part in a sectional view and in part in an exploded view.
Figure 7:
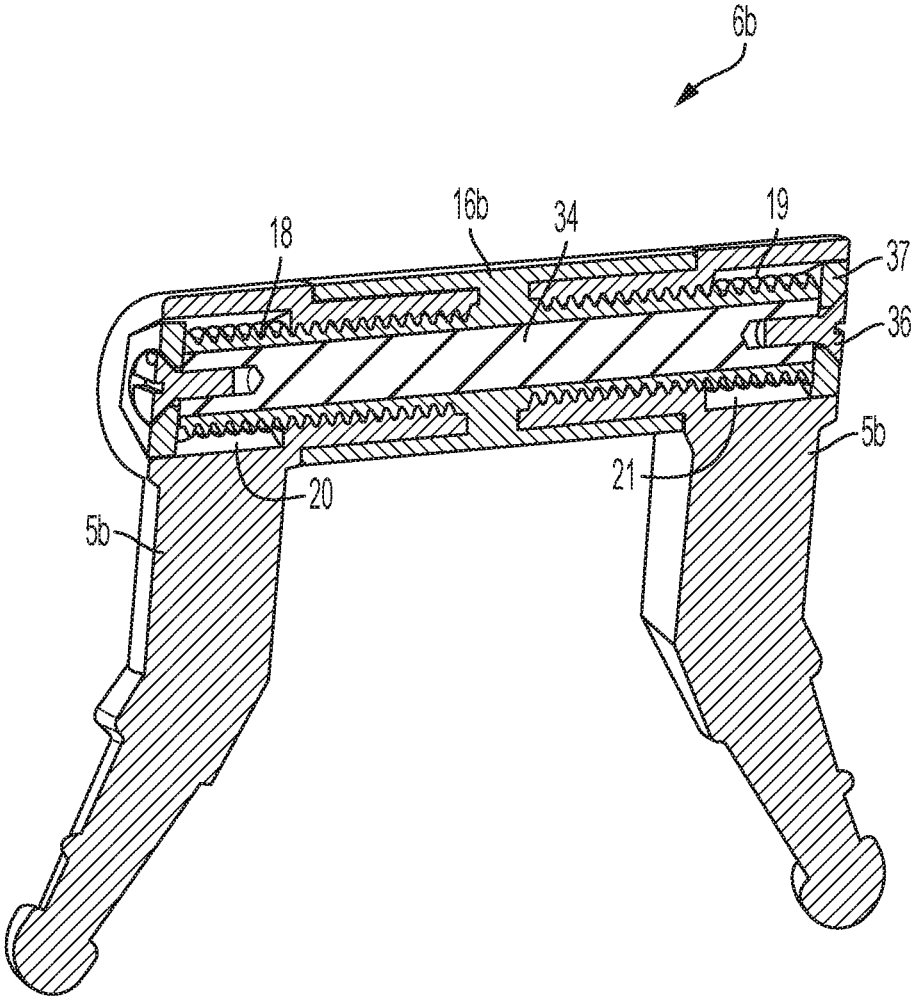
FIG. 7: shows the assembly according to FIG. 6, in the assembled state.
Figure 8:
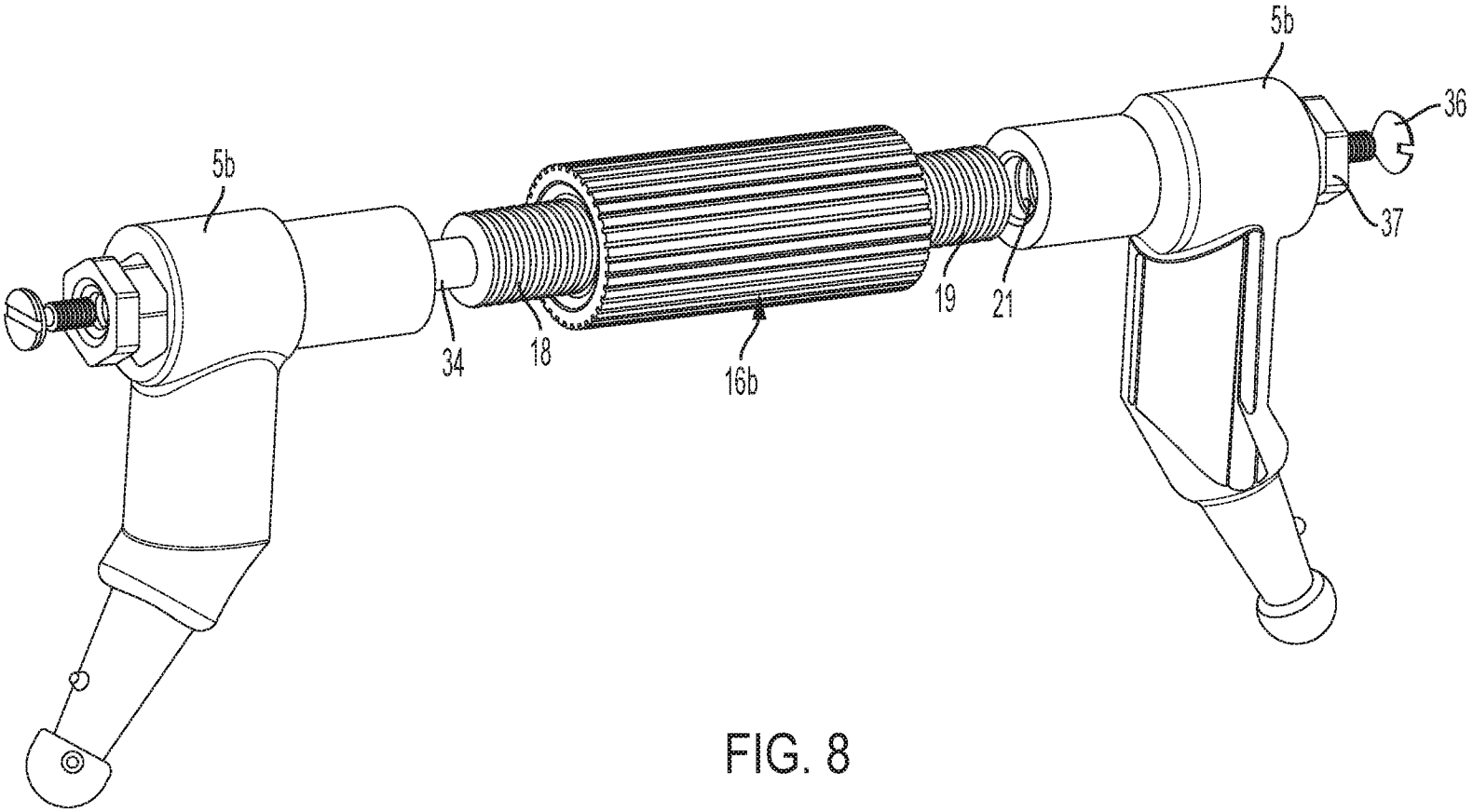
FIG. 8: shows a perspective view of the assembly according to FIG. 6.

FIGS. 6 to 8 show another exemplary embodiment, in which the twisting safeguard is formed by a central internal connecting rod 34, which serves as a rotating bearing for the rotating element 16*b*, which has—in accordance with the exemplary embodiment in FIG. 2—threaded bolts 18, 19 on its ends.

The connecting rod 34 has threaded bores 35 on each of its opposing ends, in which a locking screw 36 can be screwed, which is secured in the region of a disk 37 located on the end surface of the respective connecting piece 5*b*. The disk is preferably glued therein.

FIG. 7 shows an assembled state, while FIG. 8 shows a disassembled illustration.

Figure 9:
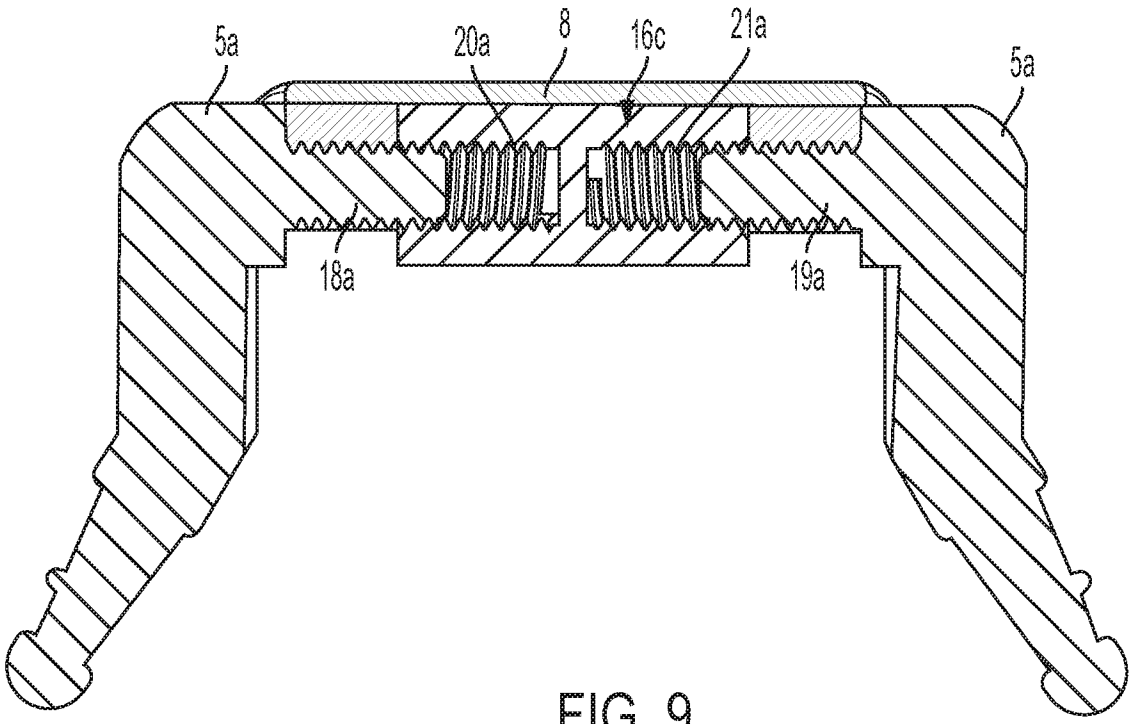
FIG. 9: shows another embodiment of the spacing adjustment at the nosepiece.

FIG. 9 shows another embodiment, in which it can be seen that a rotating element 16 is provided with opposing, threaded bores 20*a*, 21*a*, and dedicated opposing threaded bolts 18*a*, 19*a*, formed directly on the connecting pieces 5*a*, are threaded into the threaded bores 20*a*, 21*a*. This also results in excellent, convenient adjustability, and the sleeve element 8 encompasses the two head parts of the connecting pieces 5*a* to such an extent that they cannot be twisted in relation to one another. In another embodiment—not illustrated herein—a longitudinal guide for longitudinal displacement can be provided between the sleeve element 8 and the connecting pieces 5*a*.

REFERENCE SYMBOLS

1 swim goggles
2 eyepiece
3 lens
4 frame
5 connecting pieces a, b
6 adjustment means a, b, c
7 spacing
8 sleeve element 8*a*
9 gripping window
10 cylinder
11 cutout
12 headband
13 longitudinal profile
14 eye spacing
15 longitudinal groove
16 rotating element a, b, c
17 gripping sleeve
18 threaded bolt a (left-hand)
19 threaded bolt a (right-hand)
20 threaded bore (left-hand)
21 threaded bore (right-hand)
22 guide
23 head part (of 5)
24 extension
25 angled part
26 foot
27 ball joint
28 ball
29 axis of the bend
30 -
31 longitudinal groove
32 gripping surface (of 7)
33 direction of displacement
34 connecting rod
35 threaded bore (in 34)
36 locking screw
37 disk
38 longitudinal axis
39 connecting clasp
40 nub

The invention claimed is:

1. Swim goggles with an adjustable spacer, comprising a left eyepiece and a right eyepiece, and an adjustment means for adjusting the spacing between the left eyepiece and the right eyepiece, comprising a rotating element, located between a pair of connecting pieces such that the rotating element can be adjusted, and is connected to the connecting pieces with a pair of opposing threaded connections, wherein the pair of connecting pieces have a twisting safeguard that prevents a twisting of the connecting pieces counter to one another and wherein the twisting safeguard comprises a separate detachable sleeve element, which encompasses the rotating element and is non-rotatably connected with a connection to the pair of connecting pieces, the sleeve element detachable from the pair of connecting pieces with the rotating element connected to the pair of connecting pieces.

2. The swim goggles according to claim 1, wherein the connection of the sleeve element to the connecting pieces comprises a tongue and groove connection.

3. The swim goggles according to claim 1, wherein the connecting pieces comprise a substantially cylindrical head part, in which a part of one of the pair of opposing threaded connections is located.

4. The swim goggles according to claim 1, wherein a first one of the pair of connecting pieces is connected in an articulated manner to the left eyepiece with a first ball joint and a second one of the pair of connecting pieces is connected in an articulated manner to the right eyepiece with a second ball joint.

5. The swim goggles according to claim 4, further comprising:

a left frame, the left eyepiece retained in the left frame, the left frame interposed between the left eyepiece and the first one of the pair of connecting pieces, whereby the first one of the pair of connecting pieces is connected in an articulated manner to the left frame; and a right frame, the right eyepiece retained in the right frame, the right frame interposed between the right eyepiece and the second one of the pair of connecting pieces, whereby the second one of the pair of connecting pieces is connected in an articulated manner to the right frame.

6. The swim goggles according to claim 5, wherein the first ball joint comprises a first ball snappable into the left frame and the second ball joint comprise a second ball snappable into the right frame.

7. The swim goggles according to claim 1, wherein an extension is formed on a head part of each of the pair of connecting pieces at about a right angle thereto.

8. The swim goggles according to claim 1, wherein the sleeve element has a central hole in the form of a gripping window, through which the rotating element can be rotated with the fingers of a hand.

9. The swim goggles according to claim 8, wherein a pair of opposing gripping windows are formed on a circumference of the sleeve element.

10. The swim goggles according to claim 1, wherein the sleeve element has a semi-circular shape, adapted to a shape of the rotating element and a shape of the pair of the connecting pieces.

11. The swim goggles according to claim 1, wherein the pair of opposing threaded connections between the rotating element and the connecting pieces comprises a pair of threaded bolts formed on two ends of the rotating element, which are threaded into a threaded bore in each of the connecting pieces.

12. The swim goggles according to claim 1, wherein the pair of opposing threaded connections between the rotating element and the connecting pieces comprises threaded bolts formed on two ends of the connecting pieces, which are threaded into threaded bores in the rotating element.

13. Swim goggles, comprising:

a left eyepiece;

a right eyepiece;

a frame, the left eyepiece retained in the frame, the right eyepiece retained in the frame; and an adjustable spacer operable to adjust a spacing between the left eyepiece and the right eyepiece, the adjustable spacer comprising:

a rotating shaft;

a left connector connected to the left eyepiece and threadingly engaged with the rotating shaft;

a right connector connected to the right eyepiece and threadingly engaged with the rotating shaft, whereby a rotation of the rotating shaft relative to the frame adjusts a spacing between the left eyepiece and the right eyepiece; and a separate, detachable rotational lock operable to be attached to the left connector and the right connector and to prevent a rotation of the left connector relative to the right connector during the rotation of the rotating shaft, the rotational lock selectively detachable from the left connector and the right connector with the left connector and the right connector both engaged with the rotating shaft.

14. The swim goggles of claim 13, wherein the rotational lock comprises a sleeve non-rotatably connected to the left connector at a left end of the sleeve and non-rotatably connected to the right connector at a right end of the sleeve, the rotating shaft positioned in the sleeve.

15. The swim goggles of claim 13, wherein the left connector is connected to the frame via a left ball joint and the right connector is connected to the frame via a right ball joint.

* * * * *